US009528770B2

(12) United States Patent
Jiang et al.

(10) Patent No.: US 9,528,770 B2
(45) Date of Patent: Dec. 27, 2016

(54) HEAT EXCHANGER

(75) Inventors: Jianlong Jiang, Zhejiang (CN); Wei Wang, Zhejiang (CN); Linjie Huang, East Amherst, NY (US)

(73) Assignees: Sanhua (Hangzhou) Micro Channel Heat Exchanger Co., Zhejiang Province (CN); Danfoss A/S, Nordborg (DK)

( * ) Notice: Subject to any disclaimer, the term of this patent is extended or adjusted under 35 U.S.C. 154(b) by 349 days.

(21) Appl. No.: 13/083,000

(22) Filed: Apr. 8, 2011

(65) Prior Publication Data

US 2011/0247791 A1 Oct. 13, 2011

(30) Foreign Application Priority Data

Apr. 13, 2010 (CN) ..... 2010 1 0146939
Jun. 24, 2010 (CN) ..... 2010 1 0213436

(51) Int. Cl.

| | |
|---|---|
| ***F28D 7/06*** | (2006.01) |
| ***F28F 9/02*** | (2006.01) |
| ***F28D 1/00*** | (2006.01) |
| ***F28D 1/047*** | (2006.01) |
| ***F28D 1/053*** | (2006.01) |

(52) U.S. Cl.

CPC ..... *F28D 1/047* (2013.01); *F28D 1/05366* (2013.01)

(58) Field of Classification Search

CPC ..... F28D 1/047; F28D 1/05366
USPC ..... 165/172, 175, 176, 148, 149, 150, 151,165/152, 173, 185; 29/890.043
See application file for complete search history.

(56) References Cited

U.S. PATENT DOCUMENTS

| | | | | |
|---|---|---|---|---|
| 3,265,127 | A * | 8/1966 | Nickol et al. | 165/152 |
| 4,542,786 | A * | 9/1985 | Anders | 165/144 |
| 5,341,870 | A * | 8/1994 | Hughes et al. | 165/110 |
| 5,531,268 | A * | 7/1996 | Hoshino | F28D 1/0476 165/149 |
| 6,964,296 | B2 * | 11/2005 | Memory et al. | 165/151 |

(Continued)

FOREIGN PATENT DOCUMENTS

| | | |
|---|---|---|
| CN | 201697494 U | 1/2011 |
| JP | 104187990 | 7/1992 |

(Continued)

OTHER PUBLICATIONS

Equation Sheet With Length of a Bend Before Bending.*

*Primary Examiner* — Justin Jonaitis
*Assistant Examiner* — Claire Rojohn, III
(74) *Attorney, Agent, or Firm* — McCormick, Paulding & Huber LLP

(57) ABSTRACT

A heat exchanger includes first and second headers; a plurality of tubes each defining two ends connected to the first and second headers respectively. Each tube includes a bent segment and straight segments connected to first and second ends of the bent segment respectively, the bent segment being twisted relative to the straight segments. A plurality of fins are interposed between adjacent straight segments. A length of the bent segment before bending satisfies a formula: $5t\pi(180-\theta)/180+2Tw \leq A \leq 30t\pi(180-\theta)/180+8Tw$, where: A is the length of the bent segment before bending, t is a wall thickness of the tube, Tw is a width of the tube, θ is an intersection angle between the straight segments of the tube, and π is circumference ratio. The heat exchanger of embodiments of the present invention is easy to bend and convenient to manufacture without reducing the heat exchange efficiency.

20 Claims, 3 Drawing Sheets

(56) References Cited

U.S. PATENT DOCUMENTS

| | | | | |
|---|---|---|---|---|
| 7,028,764 | B2 * | 4/2006 | Reagen | 165/150 |
| 7,500,309 | B2 * | 3/2009 | Lang et al. | 29/890.03 |
| 7,921,904 | B2 * | 4/2011 | Matter et al. | 165/150 |
| 2003/0102113 | A1 * | 6/2003 | Memory et al. | 165/152 |
| 2003/0183378 | A1 * | 10/2003 | Memory | F28D 1/0476 165/153 |
| 2007/0169922 | A1 * | 7/2007 | Pautler | 165/153 |
| 2008/0202733 | A1 * | 8/2008 | Samuelson et al. | 165/153 |
| 2010/0243224 | A1 * | 9/2010 | Jianlong et al. | 165/173 |
| 2011/0232884 | A1 * | 9/2011 | Jiang | F28D 1/0426 165/173 |
| 2011/0315362 | A1 * | 12/2011 | Jiang | F28D 1/05375 165/173 |

FOREIGN PATENT DOCUMENTS

| | | | |
|---|---|---|---|
| JP | 07-146089 | A | 6/1995 |
| JP | 08-145580 | A | 6/1996 |
| JP | 2007-170718 | A | 7/2007 |

* cited by examiner

HEAT EXCHANGER

CROSS REFERENCE

This application claims priority and benefit of Chinese Patent Application No. 201010213436.0 filed with the State Intellectual Property Office of P.R. China on Jun. 24, 2010, and Chinese Patent Application No. 201010146939.0 filed with the State Intellectual Property Office of P.R. China on Apr. 13, 2010, the contents of which are incorporated herein by reference.

TECHNICAL FIELD OF THE INVENTION

The present invention generally relates to a heat exchanger, more particularly, to a heat exchanger of parallel flow type.

BACKGROUND OF THE INVENTION

The heat exchanger is widely used in various fields. A conventional heat exchanger generally has a flat and rectangular shape of so-called parallel flow type. In order to improve the heat exchange performance to meet different requirements of application and installation, a bent heat exchanger is proposed.

Due to the presence of the fins at the bent position, the heat exchanger is difficult to bend during manufacturing, the bending radius must be large, the bending angle is limited, and the installation space occupied by the heat exchanger is large. In addition, the fins at the bent position tend to be distorted, thus influencing the heat exchange performance, the water drainage performance and the appearance of the heat exchanger, and water may be blown out of or dropped into a pipe system.

For these issues, it is proposed that no fins are interposed at the bent position of the heat exchanger, that is, no fins are interposed between adjacent bent segments of the tubes, so that the bent segments of tubes are also called a segment without fins.

However, because the segments without fins do not participate in heat exchange, if the segments without fins are too long, the effective heat exchange area may be reduced, thus affecting the heat exchange performance. If the segments without fins are too short, the bending radius of the bent segments must be large, the bending angle is limited, and the installation space should be large, thus affecting the heat exchange performance, the water drainage performance and the appearance of the heat exchanger.

Moreover, for the conventional heat exchanger, the influence of bending upon the tubes is usually not taken into account when bending the tubes. The larger the stretching amount of the outer surface of the bent segments of the heat exchanger, the thinner the outer wall of the tube is, therefore, the bursting strength and the corrosion resistance of the tubes are decreased, thus shortening the life of the heat exchanger.

SUMMARY OF THE INVENTION

The present invention is directed to solving the problems existing in the prior art. Accordingly, a heat exchanger is provided, which is easy to bend and convenient to manufacture without reducing the heat exchange efficiency and destroying the appearance thereof, and the service life thereof is long.

An embodiment of the present invention provides a heat exchanger, comprising: a first header; a second header; a plurality of tubes each defining two ends connected to the first and second headers respectively to communicate with the first and second headers. Each tube comprises bent segment and straight segments connected to first and second ends of the bent segment respectively, the bent segment being twisted relative to the straight segments by a predetermined angle; and a plurality of fins are interposed between adjacent straight segments of the tubes. A length of the bent segment before bending satisfies a following formula:

$$5t\pi(180-\theta)/180+2T_w \leq A \leq 30t\pi(180-\theta)/180+8T_w$$

where: A is the length of the bent segment before bending, t is a wall thickness of the tube, $T_w$ is a width of the tube, θ is an intersection angle between the straight segments of the tube, and π is circumference ratio.

With the heat exchanger according to the embodiment of the present invention, firstly, because no fins are interposed between adjacent bent segments of the tubes, the heat exchanger is easy to bend and convenient to manufacture simply, the bending radius and the installation space may be small, there are no limits to the bending angle (i.e., the intersection angle θ) of the heat exchanger, and the water drainage performance of the bent segments is improved. Secondly, because the length of the bent segment before bending satisfies the above-identified formula, the length of each bent segment may be the permissible minimum value, thus increasing the effective heat exchange area so that the bent segments may meet the requirements of the bending of the heat exchanger, that is, the bent segments are neither too long nor too short. Thirdly, the heat exchanger after bending has an orderly appearance. Moreover, the influence of the bending upon the tubes is taken into account, so that the service life of the tubes, as well as the service life of the heat exchanger, is long.

In some embodiments of the present invention, the intersection angle θ is substantially greater than or equal to about 20° and less than or equal to about 100°. More preferably, the intersection angle θ is substantially greater than or equal to about 30° and less than or equal to about 100°.

In some embodiments of the present invention, the predetermined angle β is substantially greater than or equal to about 45° and less than or equal to about 90°.

In some embodiments of the present invention, the first ends of the bent segments of the plurality of tubes are aligned in an axial direction of the first and second headers and the second ends of the bent segments of the plurality of tubes are aligned in the axial direction.

In an alternative embodiment of the present invention, each tube comprises a plurality of bent segments each connected between two straight segments. Therefore, the heat exchanger may be bent into various shapes, such as N-shape, M-shape or W-shape.

The above summary of the present invention is not intended to describe each disclosed embodiment or every implementation of the present disclosure. The Figures and the detailed description which follow more particularly exemplify illustrative embodiments.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION OF EMBODIMENTS OF THE INVENTION

Figure 1:
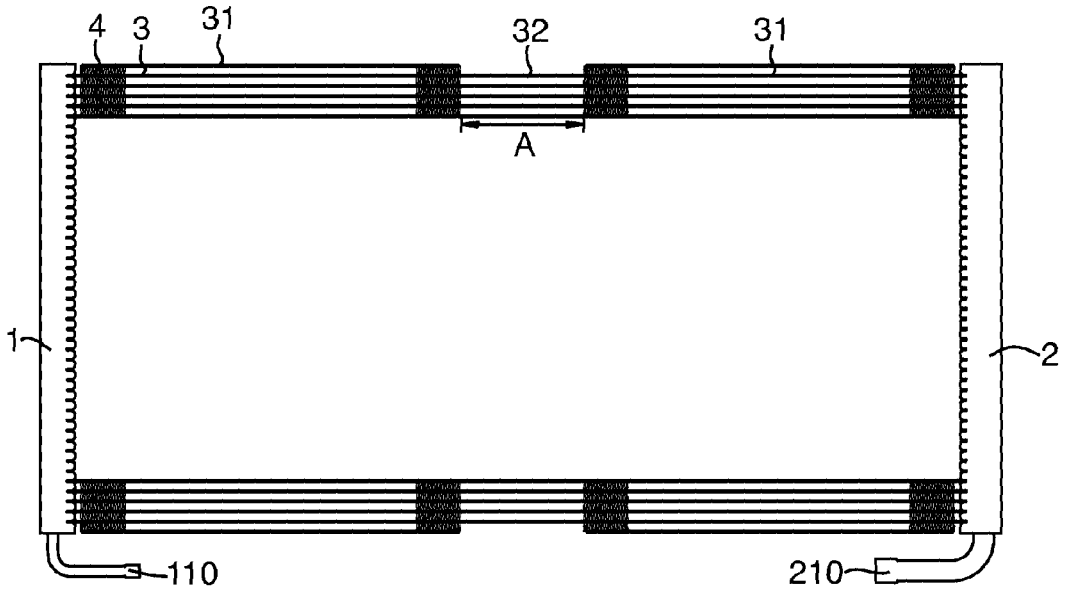
FIG. 1 is a schematic view of a heat exchanger according to an embodiment of the present invention before the tubes are twisted and bent.

Reference will be made in detail to embodiments of the present invention. The embodiments described herein with reference to the accompany drawings are explanatory and illustrative, which are used to generally understand the present invention. The embodiments shall not be construed to limit the present invention. The same or similar elements and the elements having same or similar functions are denoted by like reference numerals throughout the descriptions.

It is to be understood that phraseology and terminology used herein with reference to device or element orientation (such as, terms like "longitudinal", "lateral", "front", "rear", "right", "left", "lower", "upper", "horizontal", "vertical", "above", "below", "up", "top", "bottom" as well as derivative thereof such as "horizontally", "downwardly", "upwardly", etc.) are only used to simplify description of the present invention, and do not alone indicate or imply that the device or element referred to must have or operate in a particular orientation. In addition, terms such as "first" and "second" are used herein for purposes of description and are not intended to indicate or imply relative importance or significance.

Unless specified or limited otherwise, the terms "mounted," "connected," "supported," and "coupled" and variations thereof are used broadly and encompass both direct and indirect mountings, connections, supports, and couplings.

A heat exchanger according to an embodiment of the present invention will be described below with reference to FIGS. 1-4.

Figure 2:
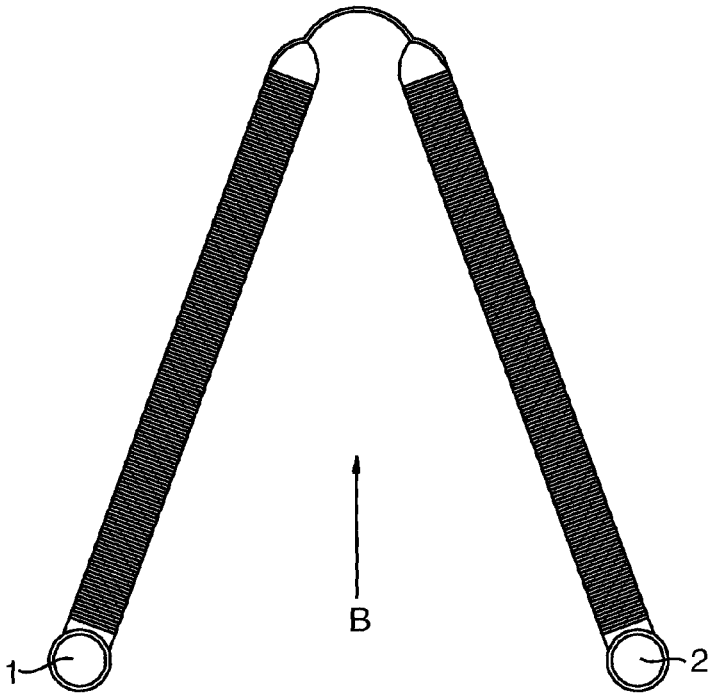
FIG. 2 is a schematic view of a heat exchanger according to an embodiment of the present invention after the tubes are twisted and bent.

As shown in FIGS. 1-2, the heat exchanger according to an embodiment of the present invention comprises a first header 1, a second header 2, a plurality of tubes 3, and a plurality of fins 4.

The first header 1 and the second header 2 are disposed substantially parallel to each other and spaced apart from each other at a predetermined interval. For example, the first header 1 may be used as an inlet header connected with an inlet pipe 110, and the second header 2 may be used as an outlet header connected with an outlet pipe 210.

Figure 3:
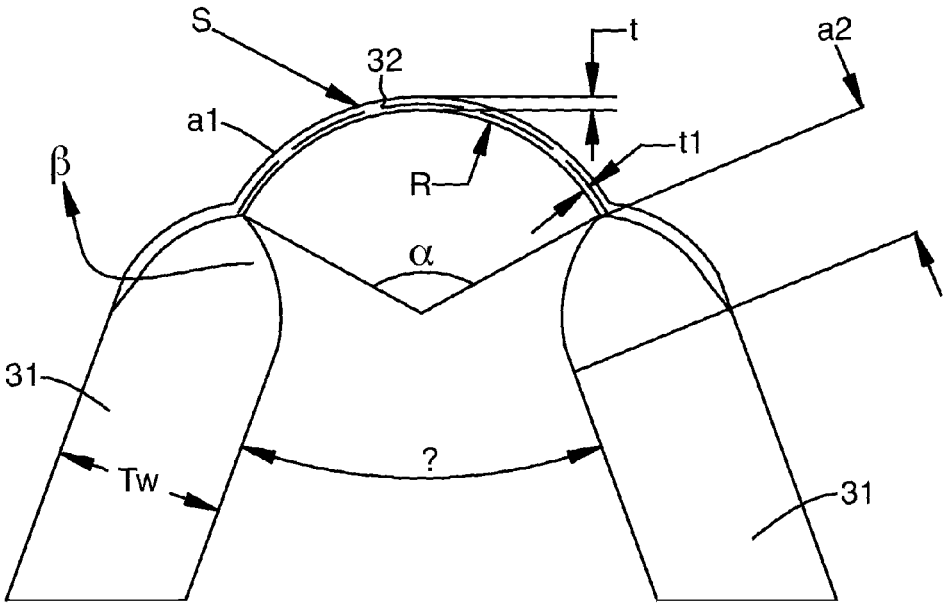
FIG. 3 is a schematic view of a length of a bent tube of the heat exchanger according to an embodiment of the present invention.

Two ends of each tube 3, such as flat tube, are connected to the first header 1 and the second header 2 respectively to communicate with the first header 1 and the second header 2 via refrigerant channels formed in each tube 3. In this embodiment, as shown in FIGS. 2-3, each tube 3 comprises two straight segments 31 and one bent segment 32, the two straight segments 31 are connected to first and second ends of the bent segment 32, and the bent segment 31 is twisted relative to the two straight segments 31 by a predetermined angle β.

In one embodiment, in order to manufacture the heat exchanger, a portion (for example, a middle portion which is to be the bent segment 32) of each tube 3 may be twisted relative to the remaining portion of the tube 3, and then the tube 3 is bent at the portion once such that the tube 3 is divided into the two straight segments 31 and one bent segment 32 connected between the two straight segments 31 before assembling and welding of the heat exchanger. Next, the twisted and bent tubes 3 are connected to the first header 1 and the second header 2, and each fin 4 is interposed between adjacent tubes 3, so that the heat exchanger is assembled, in which no fins 4 are interposed between adjacent bent segments 32 of the tubes 3. Finally, the tubes 3, the first header 1, the second header 2 and the fins 4 are welded together.

In an alternative embodiment, the tubes 3 are connected to the first header 1 and the second header 2 before bending and twisting, and each fin 4 is interposed between adjacent tubes 3, in which no fins 4 are disposed between portions of tubes 3 which are to be bent. Then the tubes 3, the first header 1, the second header 2 and the fins 4 are welded together. Finally, the portion of each tube 3 is twisted and then each tube 3 is bent at the portion without fins such that the portion of each tube 3 forms the bent segment of the tube 3. It is appreciated that the plurality of tubes 3 may be simultaneously twisted and bent.

As shown in FIG. 1, the heat exchanger according to the embodiment of the present invention is straightened to show a length A of each bent segment 32 before bending and twisting relative to the two straight segments 31. As shown in FIG. 2, the heat exchanger is bent and thereby divided into a left heat exchanger portion and a right heat exchanger portion located at two sides of the bent segments 32 respectively.

Figure 4:
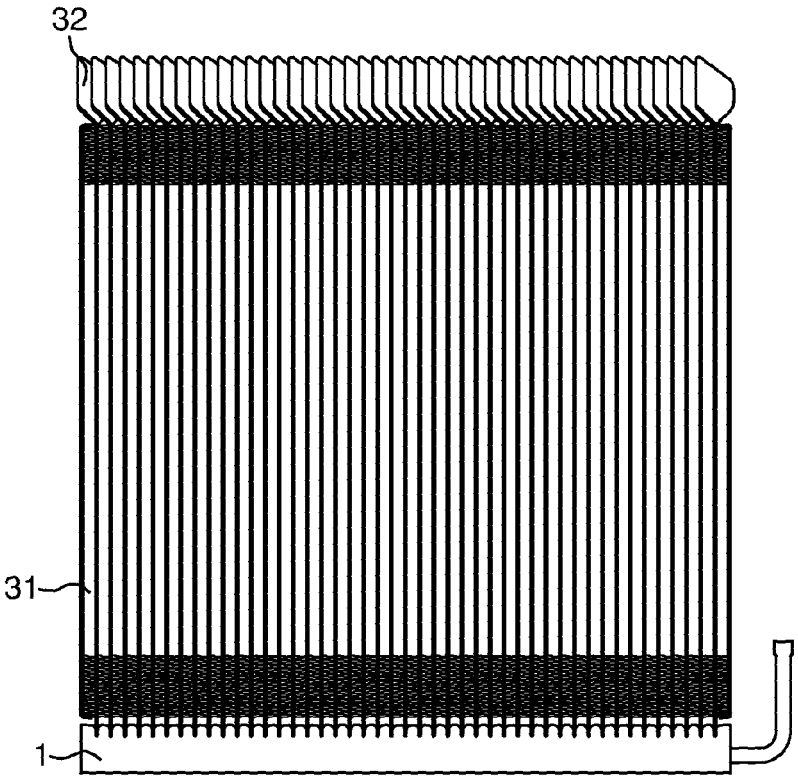
FIG. 4 is a side view of the heat exchanger shown in FIG. 2 in which the tubes are twisted and not bent.

As shown in FIGS. 1-2 and 4, each fin 4 is interposed between adjacent straight segments 31, but no fins 4 are interposed between adjacent bent segments 32. Here, the bent segment 32 may be also called a segment without fins, and the straight segment 31 may be also called a segment with fins.

The length A of the bent segment 32 of each tube 3 before bending satisfies the following formula:

$$5t\pi(180-\theta)/180+2T_w \le A \le 30t\pi(180-\theta)/180+8T_w$$

in which A is the length of the bent segment 32 before bending, t is a wall thickness of the tube 3 (i.e., a size of the tube 3 in an up and down direction in FIG. 1), $T_w$ is a width of the tube 3, θ is an intersection angle between the straight segments 31 of the tube 3 after bending the tube 3 (i.e., the bending angle of the heat exchanger), and π is circumference ratio.

In one particular embodiment of the present disclosure, the tube 3 is a flat tube having a substantially oblong cross-section, which is constituted by a middle rectangle and two semicircles connected to two ends of the rectangle. It should be noted that the cross-section of the tube 3 is not limited to the above shape, for example, the cross-section of the tube 3 may be a flat ellipse or a square.

With the heat exchanger according to embodiments of the present invention, because the tube 3 comprises the bent segment 32 (i.e., the segment without fins), the heat exchanger is easy to bend and convenient to manufacture simply, the bending radius and the occupying space may be small, the bending angle θ of the heat exchanger is not limited, and the water drainage performance is improved.

Further, because the length A of the bent segment 32 before bending satisfies the above formula, the length of the bent segment 32 may reach the permissible minimum value, thus increasing the effective heat exchange area. Therefore, the bent segment 32 may meet the requirements of the bending of the heat exchanger, and the bending and the heat exchange efficiency of the heat exchanger may not be affected, that is, the bent segments 32 may be neither too long nor too short. Meanwhile, the heat exchanger after bending has orderly appearance. Moreover, the influence of the bending upon the tubes 3 is taken into account, so that the service life of the tubes 3 and the life of the heat exchanger is prolonged.

The determination of the length A of the bent segment 32 of each tube 3 will be further described below with reference to FIG. 3.

As shown in FIG. 3, the stretching amount S of an upper wall (i.e., the outer surface) of the tube 3 has a direct relationship to the wall thickness t of the tube 3. The larger the stretching amount S, the thinner the upper wall of the tube 3 is and the lower the bursting strength and the corrosion resistance of the tube 3 are. Therefore, the stretching amount S of the upper wall should be controlled.

As shown in FIG. 3, the stretching amount $S=\pi\alpha(t-t_1)/180=\pi(180-\theta)(t-t_1)/180$, in which $t_1$ is a thickness from a center of the bent segment 32 to an inner side (i.e., the lower surface in FIG. 3) of the bent segment 32 of the tube 3, α is a central angle of the bent segment 32 excluding the twisted end portions (it should be understand that the bent segment is twisted by twisting the two end portions thereof, so that the two end portions of the bent segment is called twisted portions), and θ is the intersection angle between the two straight segments 31 of the tube 3 (i.e., the bending angle of the heat exchanger).

It may be known from the above formula that the stretching amount S has a direct relationship to the angle θ, the wall thickness t of the tube 3 and the bending radius R. If the angle θ is constant, the stretching amount S is in direct proportion to t and in inverse proportion to R. In order to improve the strength and the corrosion resistance of the tube 3, it is required that the stretching amount S be as small as possible, and it has been proven by research that it is advantageous to set $R/t\geq 5$. Meanwhile, if the arc length of the outer surface is kept constant, the larger the bending radius R, the flatter the outer surface is, which is disadvantageous for the water drainage performance of the outer surface, and water may directly drop from the outer surface. It has been proven by research that it is advantageous to set $R/t\leq 30$. Therefore, it is advantageous that R is greater than or equal to 5t and less than or equal to 30t.

In FIG. 3, $a_2$ is the length of the twisted portion of the bent segment 32, and mainly depends on the twisting force. The twisting force is in direct proportion to the width $T_w$ of the tube 3. For a given width $T_w$, the smaller the length $a_2$ of the twisted portion, the larger the twisting force is and the more easily the fins 4 deform. Therefore, the larger the length $a_2$ of the twisted portion, the more difficult fin deformation is. Since the twisted portion does not participate in heat exchange, if the twisted portion is too long, the heat exchange efficiency of the heat exchanger will be affected disadvantageously. It has been proven by research that it is advantageous to set $T_w\leq a_2\leq 4T_w$.

Moreover, the length $a_2$ of the twisted portion also has a direct relationship to the angle β by which the bent segment 32 is twisted relative to the two straight segments 31. The larger the angle β, the larger the length $a_2$ is, and the larger the length A of the bent segment 32 is. It has been proven by research that it is advantageous to set $45°\leq\beta\leq 90°$.

As shown in FIG. 3, the length A of the bent segment 32 is:

$$A=a_1+2a_2=\pi R\alpha/180+2a_2=\pi R(180-\theta)/180+2a_2$$

in which $a_1$ is an arc length of the bent segment excluding the two twisted portions, and $a_2$ is the length of the twisted portion.

The following formula is obtained by substituting the relation expressions of R and $a_2$ into the above formula of A:

$$5t\pi(180-\theta)/180+2T_w\leq A\leq 30t\pi(180-\theta)/180+8T_w$$

In use, as shown in FIG. 2, a uniformity of an air stream B on a surface of the heat exchanger has a direct relationship to an angle θ/2 between the air stream B and the heat exchanger (i.e., a half of the intersection angle between the two straight segments 31 of the tube 3). The larger the angle θ, the more uniform the air stream on the surface of the heat exchanger is.

However, when the heat exchanger is used as an evaporator, condensed water may be generated on the surface of the heat exchanger during operation. If θ is increased blindly, the condensed water on the surface of the heat exchanger may drop into the pipe below the heat exchanger, which is not permitted. It has been proven by research that it is advantageous to set the intersection angle θ in a range of about 20°-100°. When the heat exchanger is disposed horizontally, it has been proven by research that it is advantageous to set the intersection angle θ in a range of about 30°-100°.

As shown in FIG. 1 and FIG. 4, in some embodiments of the present invention, the first ends of the bent segments 32 of the plurality of tubes 3 are aligned in an axial direction (i.e., the up and down direction in FIG. 1 or the left and right direction in FIG. 4) of the first header 1 and the second header 2, and the second ends of the bent segments 32 are also aligned in the axial direction. As shown in FIG. 4, the bent segments 32 overlap partly with each other. Therefore, the heat exchanger has an orderly appearance, and the deformation of the heat exchanger is uniform and easy to control during manufacturing, thus improving the rate of finished products.

Figure 5:
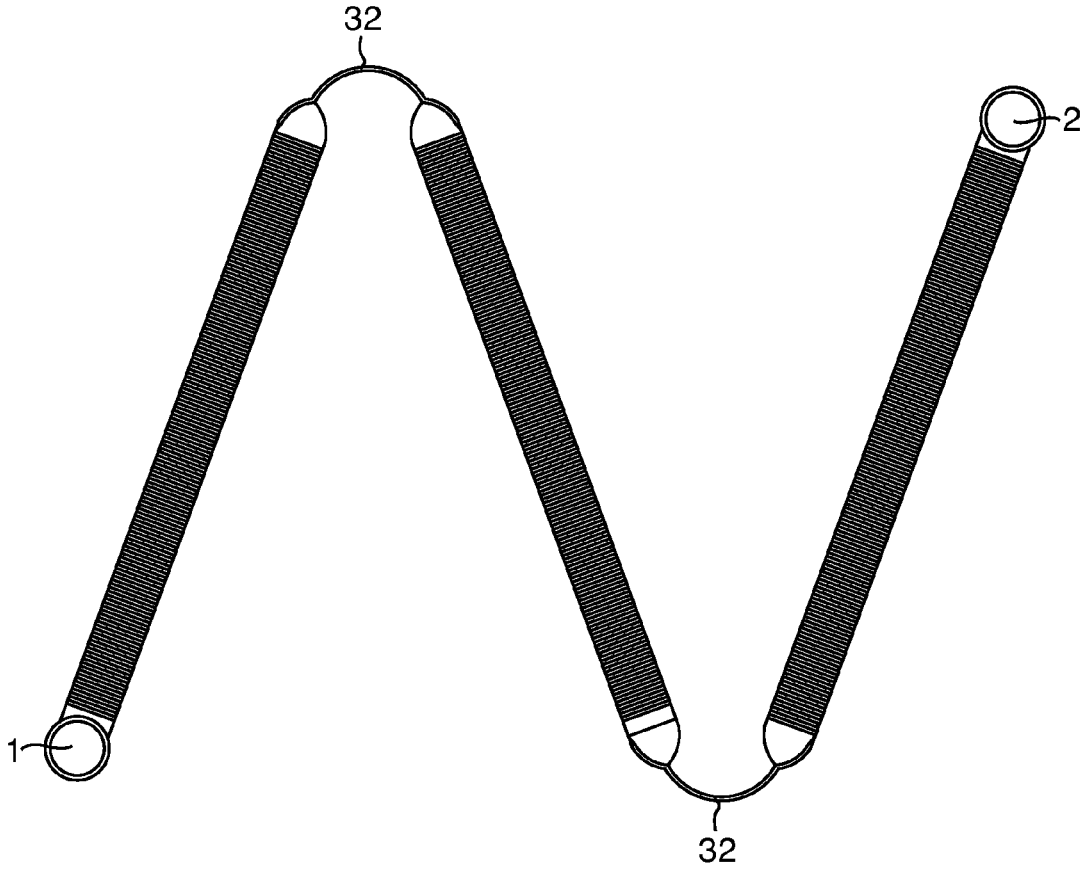
FIG. 5 is a schematic view of a heat exchanger according to another embodiment of the present invention.

In the above embodiments, each tube 3 comprises one bent segment 32 such that the heat exchanger is bent into a substantially inverted V-shape. In some embodiments of the present invention, each tube 3 may comprise a plurality of bent segments 32 each connected between two straight segments 31, so that the heat exchanger may be bent into various shapes, such as N-shape, M-shape or W-shape. As shown in FIG. 5, the heat exchanger is bent into N-shape.

Reference throughout this specification to "an embodiment", "some embodiments", "one embodiment", "an example", "a specific example", or "some examples" means that a particular feature, structure, material, or characteristic described in connection with the embodiment or example is included in at least one embodiment or example of the invention. Thus, the appearances of the phrases such as "in some embodiments", "in one embodiment", "in an embodiment", "an example", "a specific example", or "some examples" in various places throughout this specification are not necessarily referring to the same embodiment or example of the invention. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications all falling into the scope of the claims and their equivalents may be made in the embodiments without departing from spirit and principles of the present invention.

What is claimed is:

1. A heat exchanger, comprising:

a first header;

a second header;

a plurality of tubes each defining two ends connected to the first and second headers respectively to communicate with the first and second headers, wherein each tube comprises a bent segment and straight segments connected to first and second ends of the bent segment respectively, the bent segment including a twisted portion at each end thereof defining a predetermined angle at which the bent segment is twisted relative to the straight segments; and a plurality of fins each interposed between adjacent straight segments, wherein no fins are interposed between adjacent bent segments, wherein a length of the bent segment before bending satisfies a following formula:

$$5t\pi(180-\theta)/180+2T_w \leq A \leq 30t\pi(180-\theta)/180+8T_w$$

where: A is the length of the bent segment before bending, t is a wall thickness of the tube, $T_w$ is a width of the tube, θ is an intersection angle between the straight segments of the tube, and π is circumference ratio; and wherein a length of each twisted portion of the bent segment is in the direction of the tube and perpendicular to longitudinal axes of the headers connected by the plurality of tubes, the length being within the range of $T_w$ to $4T_w$.

2. The heat exchanger according to claim 1, wherein the intersection angle θ is substantially greater than or equal to about 20° and less than or equal to about 100°.

3. The heat exchanger according to claim 2, wherein the intersection angle θ is substantially greater than or equal to about 30° and less than or equal to about 100°.

4. The heat exchanger according to claim 1, wherein the predetermined angle β is substantially greater than or equal to about 45° and less than or equal to about 90°.

5. The heat exchanger according to claim 1, wherein the first ends of the bent segments of the plurality of tubes are aligned in an axial direction of the first and second headers and the second ends of the bent segments of the plurality of tubes are aligned in the axial direction.

6. The heat exchanger according to claim 1, wherein each tube comprises a plurality of bent segments each connected between two straight segments.

7. The heat exchanger according to claim 1, wherein a bending radius R of the bent segment is greater than or equal to 5t and less than or equal to 30t.

8. A heat exchanger, comprising:

a first header;

a second header;

a plurality of tubes connected to both the first and second headers to communicate with the first and second headers, wherein each tube comprises a bent segment interposed between straight segments and connected thereto by twisted portions defining a predetermined angle at which the bent segment is twisted relative to the straight segments; and a plurality of fins each interposed between adjacent straight segments but not interposed between adjacent bent segments or twisted portions, wherein a length of the bent segment before bending satisfies a following formula:

$$5t\pi(180-\theta)/180+2T_w \leq A \leq 30t\pi(180-\theta)/180+8T_w$$

where: A is the length of the bent segment before bending, t is a wall thickness of the tube, $T_w$ is a width of the tube, θ is an intersection angle between the straight segments of the tube, and π is circumference ratio; and wherein a length of each twisted portion is in the direction of the tube and perpendicular to a longitudinal axes of the nearest of the first header or second header, the length being within the range of $T_w$ to $4T_w$.

9. The heat exchanger according to claim 8, wherein the intersection angle θ is substantially greater than or equal to about 20° and less than or equal to about 100°.

10. The heat exchanger according to claim 9, wherein the intersection angle θ is substantially greater than or equal to about 30° and less than or equal to about 100°.

11. The heat exchanger according to claim 8, wherein the predetermined angle β is substantially greater than or equal to about 45° and less than or equal to about 90°.

12. The heat exchanger according to claim 8, wherein the first ends of the bent segments of the plurality of tubes are aligned in an axial direction of the first and second headers and the second ends of the bent segments of the plurality of tubes are aligned in the axial direction.

13. The heat exchanger according to claim 8, wherein each tube comprises a plurality of bent segments each connected between two straight segments.

14. The heat exchanger according to claim 8, wherein a bending radius R of the bent segment is greater than or equal to 5t and less than or equal to 30t.

15. A heat exchanger, comprising:

a first header;

a second header;

a plurality of tubes each defining two ends connected to the first and second headers respectively to communicate with the first and second headers, wherein each tube comprises a bent segment and straight segments connected to first and second ends of the bent segment respectively, the bent segment including a twisted portion at each end thereof defining a predetermined angle at which the bent segment is twisted relative to the straight segments; and a plurality of fins each interposed between adjacent straight segments, wherein no fins are interposed between adjacent bent segments, wherein a length of the bent segment before bending satisfies a following formula:

$$5t\pi(180-\theta)/180+2T_w \leq A \leq 30t\pi(180-\theta)/180+8T_w$$

where: A is the length of the bent segment before bending, t is a wall thickness of the tube, $T_w$ is a width of the tube, θ is an intersection angle between the straight segments of the tube, and π is circumference ratio; and wherein a length of each twisted portion of the bent segment is in the direction of the tube and perpendicular to longitudinal axes of the headers, the length being within the range of $T_w$ to $4T_w$.

16. The heat exchanger according to claim 15, wherein the intersection angle θ is substantially greater than or equal to about 20° and less than or equal to about 100°.

17. The heat exchanger according to claim 16, wherein the intersection angle θ is substantially greater than or equal to about 30° and less than or equal to about 100°.

18. The heat exchanger according to claim 15, wherein the predetermined angle β is substantially greater than or equal to about 45° and less than or equal to about 90°.

19. The heat exchanger according to claim 15, wherein the first ends of the bent segments of the plurality of tubes are aligned in an axial direction of the first and second headers and the second ends of the bent segments of the plurality of tubes are aligned in the axial direction.

20. The heat exchanger according to claim 15, wherein a bending radius R of the bent segment is greater than or equal to 5t and less than or equal to 30t.

* * * * *